US007305732B2

(12) United States Patent
Karroll

(10) Patent No.: US 7,305,732 B2
(45) Date of Patent: Dec. 11, 2007

(54) PAINT ROLLER WITH SHIELD

(75) Inventor: David Karroll, Rimbey (CA)

(73) Assignee: Quic-Key Painter Ltd., Rimbey (CA)

( * ) Notice: Subject to any disclaimer, the term of this patent is extended or adjusted under 35 U.S.C. 154(b) by 0 days.

(21) Appl. No.: 10/906,642

(22) Filed: Feb. 28, 2005

(65) Prior Publication Data

US 2006/0162110 A1 Jul. 27, 2006

(30) Foreign Application Priority Data

Jan. 27, 2005 (CA) ..... 2494794

(51) Int. Cl.
*B05C 17/02* (2006.01)

(52) U.S. Cl. ..... 15/230.11; 15/248.2; 492/13; 492/19; 492/47; 492/48

(58) Field of Classification Search ..... 15/230.11, 15/248.1, 248.2; 492/13, 16, 19, 47, 48; D4/122; 401/193
See application file for complete search history.

(56) References Cited

U.S. PATENT DOCUMENTS 2,591,530 A * 4/1952 Findley et al. ..... 401/197
2,644,186 A * 7/1953 Guimond ..... 15/230.11
2,663,892 A * 12/1953 Schaefer ..... 15/230.11
2,684,497 A * 7/1954 Graham ..... 401/197
2,722,030 A * 11/1955 Van Clief, Jr. ..... 401/197
2,763,022 A * 9/1956 Glacken ..... 15/248.2
2,836,840 A * 6/1958 Pratt ..... 15/230.11
2,972,158 A * 2/1961 Voskresenski ..... 15/244.2
3,685,084 A * 8/1972 Bennett ..... 15/230.11
3,751,748 A * 8/1973 Roe et al. ..... 15/230.11
4,320,553 A * 3/1982 Charles ..... 15/230.11
4,599,762 A * 7/1986 Rigter ..... 15/248.2
5,795,279 A * 8/1998 Shieh ..... 492/13
6,128,802 A * 10/2000 Lye ..... 15/230.11

FOREIGN PATENT DOCUMENTS

DE 19531385 * 2/1997

* cited by examiner

*Primary Examiner*—Gary K. Graham
(74) *Attorney, Agent, or Firm*—Bennett Jones LLP

(57) ABSTRACT

A paint roller sleeve includes an inner tube, an outer pile surface, an end cap, a circular disk shaped shield disposed between the end cap and the inner tube, and a foam disk disposed between the shield and the pile surface.

6 Claims, 2 Drawing Sheets

PAINT ROLLER WITH SHIELD

CROSS REFERENCE TO RELATED APPLICATIONS

This application claims the priority benefit of Canadian Patent Application No. 2,494,794 filed on Jan. 27, 2005 entitled "Paint Roller Shield", the contents of which are incorporated herein by reference.

BACKGROUND OF INVENTION

The present invention relates to a paint roller shield.

Interior surfaces in a house or commercial premises are typically painted using a combination of roller application and brush applications. Paint is brushed on near edges or surfaces which are not to be painted, such as around doorways, windows and ceilings. These surfaces are usually masked with tape to prevent contact with paint. "Cutting in" around these surfaces with a brush is a time-consuming and laborious exercise.

As well, after some use, the pile near the end of a paint roller tends to flare outward, past the end of the roller. As a result, painting near an inside corner or an adjoining trim or moulding is difficult without adding unwanted paint to an adjoining surface.

Various devices have been proposed to make this task easier. Simple straight-edge guards used in combination with a brush provides some benefit. It is known to use edge guards in combination with rollers, as seen in U.S. Pat. No. 5,444,891. These guards do not work entirely satisfactorily. If the roller is positioned too close to the guard, paint will build up along the guard and will likely find its way onto the edge or surface which is not to be painted. Alternatively, if the roller is set apart from the edge guard, a uniform painted surface right up to the edge cannot be achieved. Furthermore, these devices cannot be used along irregular surfaces such as textured ceilings and or other irregular surfaces.

Therefore, there is a need in the art for an improved paint applicator system which mitigates the difficulties of the prior art. The present invention provides an improved paint roller sleeve having an integral shield.

BRIEF DESCRIPTION OF DRAWINGS

The invention will now be described by way of an exemplary embodiment with reference to the accompanying simplified, diagrammatic, not-to-scale drawings.

DETAILED DESCRIPTION

Figure 1:
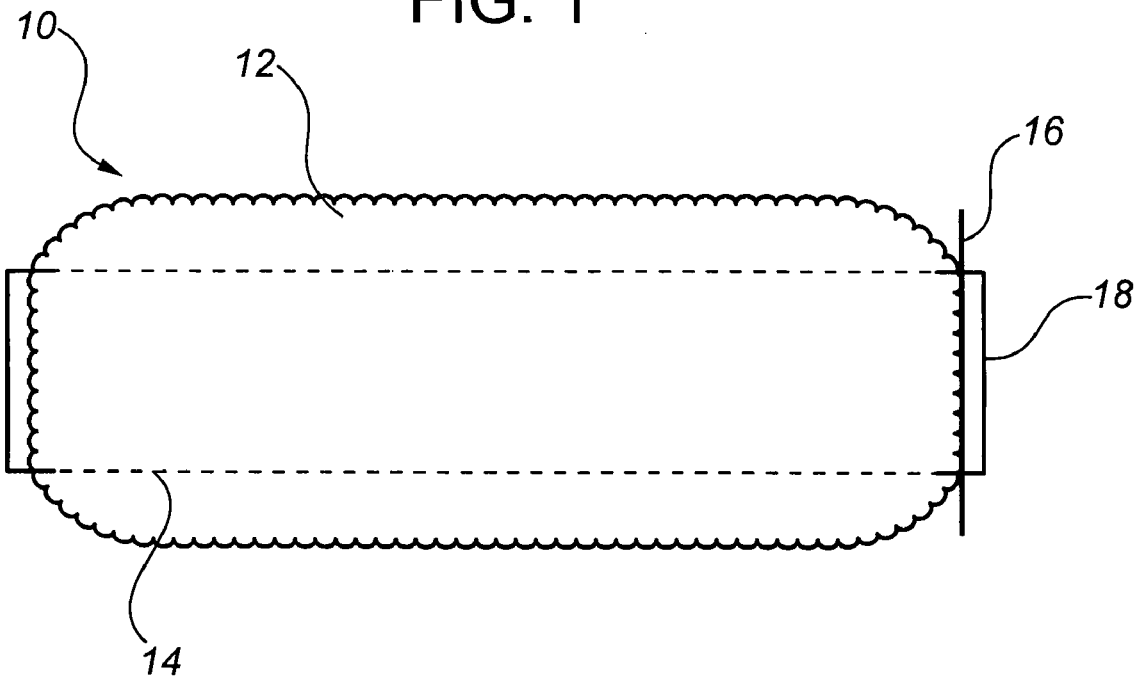
FIG. 1 is a pictorial view of one embodiment of the present invention.

The present invention provides for a novel paint roller. When describing the present invention, all terms not defined herein have their common art-recognized meanings.

The roller sleeve (10) described and illustrated herein has a paint applying surface comprising a felt pile (12), as is well known in the art. The roller sleeve (10) comprises an inner tube (14) which is adapted to slide onto the wire cage of a paint roller (not shown) in a conventional manner.

The sleeve comprises an end cap (18) which serves to prevent paint from entering the inner tube (14) and, in this invention, to retain the shield (16). The shield comprises a thin circular disk, centered with the longitudinal axis of the roller sleeve. The shield serves as an edge guide when painting up against edges to prevent the pile (12) from contacting the edge and applying unwanted paint.

The end cap (18) may snap on the inner tube (14) in a like manner to that described in Canadian Patent 2003105, or otherwise engage the inner tube, whereby the shield (16) is retained between the end cap and the inner tube.

In a preferred embodiment, the shield is a very thin plastic material, less than about 0.5 mm and more preferably less than about 0.1 mm. A thin shield will be inherently flexible, but should still be rigid enough to act as an effective paint shield in operation. The material used in transparent film, such as those used for overhead projectors, is a suitable material. Other resilient or flexible materials such as rubber or metal may also be used.

The diameter of the shield must be less than the uncompressed diameter of the paint applying surface. In use, the paint applying surface will compress slightly, and it is undesirable than the edge of the shield directly contact the painted surface with much force. It is preferred that the diameter of the shield match the compressibility of the felt pile such that in use, the shield barely touches the painted surface, or comes very close to the surface without contact.

Figure 2:
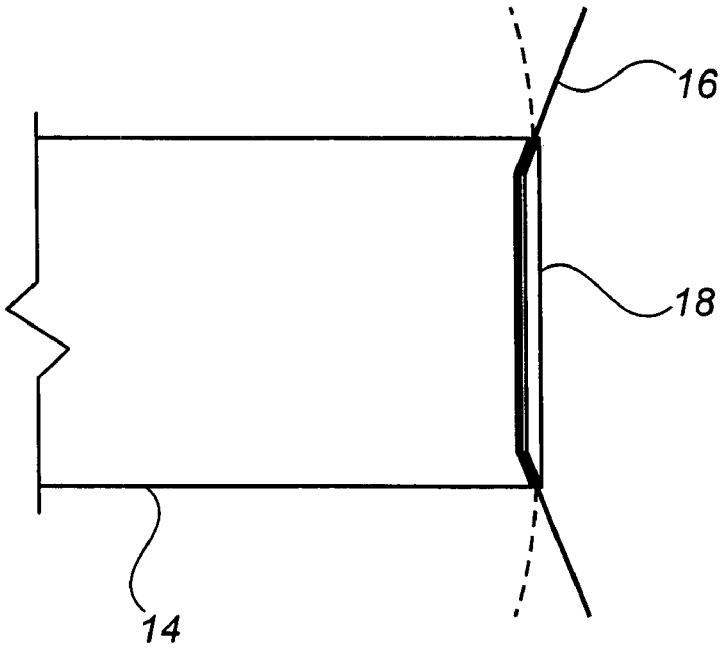
FIG. 2 is a view of an alternative embodiment.

A circular disk of a thin flexible material, when pressed by the end cap into slightly bevelled opening of the inner tube (14), as shown in FIG. 2, will assume a slightly convex shape. Also, the shield may be "flipped" over into a concave shape as shown in the dashed lines. The inventor has found that this feature provides some additional benefits in operation. As well, it is preferred that the pile (12) not be cylindrical right to the end of the roller, but is bevelled down towards the end cap, as is shown in FIG. 1. Alternatively or additionally, the pile may end slightly before the shield and end cap, leaving a gap of less than about 1 mm or less between the edge of the pile and the shield.

The sleeve (10) of the present invention may easily be adapted to wire cages with or without an end cap.

In an alternative embodiment, a circular foam disk (20) may be provided adjacent to the shield (16), on the interior side of the shield. The foam disk (20) serves to soak up excess paint which migrates towards the shield (16), as well as apply paint as the roller is being used. The foam may of the type typically used in foam paint rollers and foam paint brushes. In one embodiment, the foam disk (20) may be between about 1.5 mm to 2 mm thick, and have a diameter that is substantially the same as the shield (16). The density of the foam and the thickness of the disk (20) may be varied according to the viscosity of the paint and other variables known to those skilled in the art.

Figure 3:
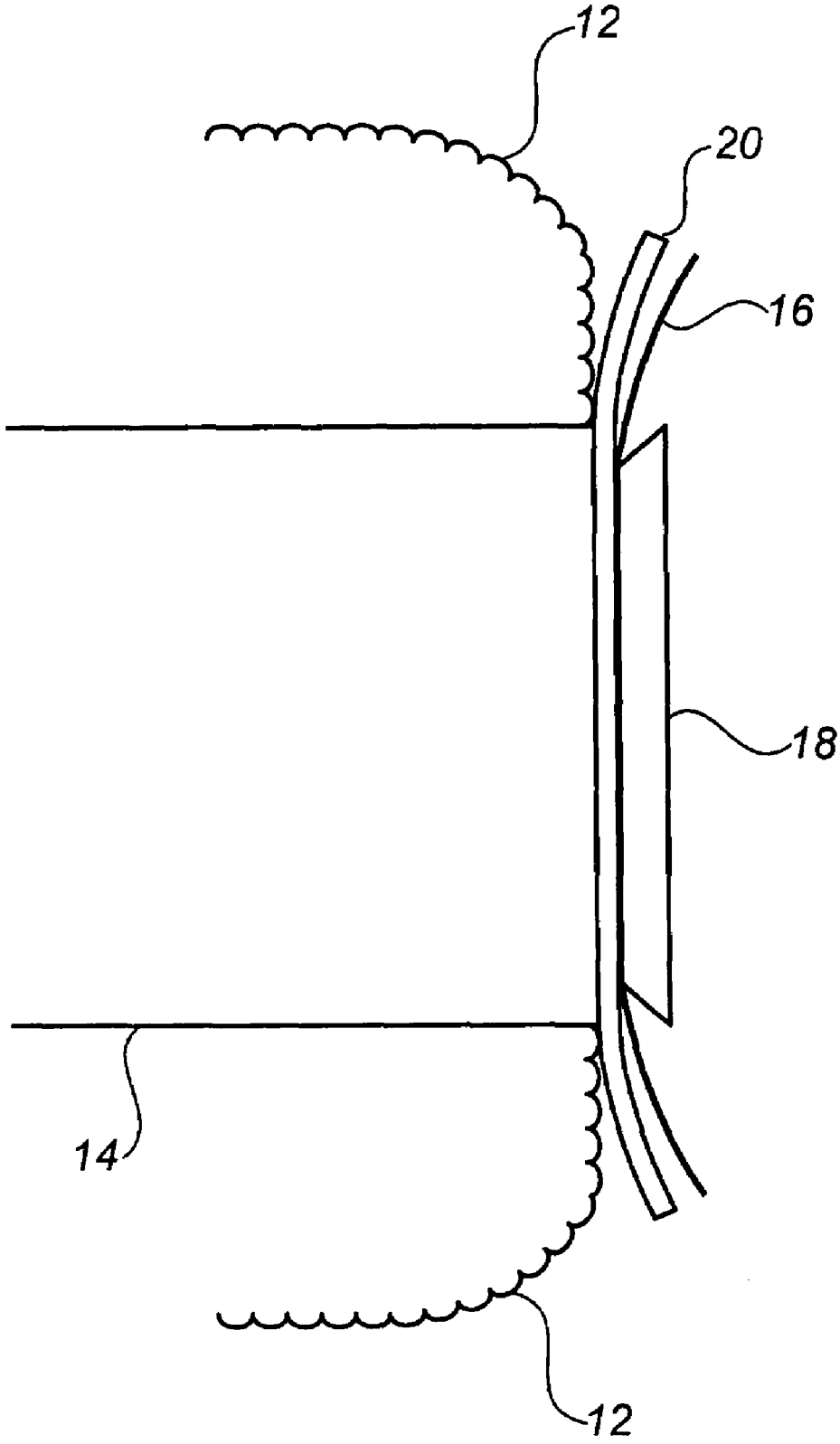
FIG. 3 is a view of a further alternative embodiment.

As seen in FIG. 3, in a preferred embodiment, the foam disk (20) is compressed in the middle upon insertion of the end cap (18), therefore, the foam disk (20) will assume a convex shape similar to the shield (16).

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

What is claimed is:

1. A paint roller comprising:

(a) a hollow cylindrical tube having a paint applying surface and a longitudinal axis;

(b) a cylindrical end cap, substantially perpendicular to the longitudinal axis of the tube and engaging one end of the tube; and (c) a flexible circular shield disposed between the end cap and said end of the tube, the shield being retained by the end cap: and (d) a porous flexible disk, disposed adjacent to the shield wherein the disk and the shield curve away from the paint applying surface.

2. The paint roller of claim 1 wherein the shield comprises a plastic material not thicker than about 0.5 mm.

3. The paint roller of claim 1 wherein the shield has a diameter less than the uncompressed diameter of the paint applying surface.

4. The paint roller of claim 1 wherein the disk has a diameter substantially the same as the shield.

5. The paint roller of claim 1 wherein the disk comprises a foam disk, having a thickness of less than about 5 mm.

6. The paint roller of claim 5 wherein the foam disk has a thickness of about 1.5 mm to about 2 mm.

* * * * *